United States Patent [19]

Clerc-Renaud et al.

[11] Patent Number: 4,798,662

[45] Date of Patent: Jan. 17, 1989

[54] CATHODE FOR ELECTROLYSIS AND A PROCESS FOR THE MANUFACTURE OF THE SAID CATHODE

[75] Inventors: Jacques Clerc-Renaud, La Mulatiere; Francis Leroux, Brignais; Dominique Ravier, Lyons, all of France

[73] Assignee: Atochem, France

[21] Appl. No.: 31,086

[22] Filed: Mar. 26, 1987

[30] Foreign Application Priority Data

Apr. 3, 1986 [FR] France ..... 86 04767

[51] Int. Cl.[4] ..... C25B 11/00-

[52] U.S. Cl. ..... 204/290 R; 204/290 F; 427/226; 427/229; 427/303.7; 427/405; 427/419.2

[58] Field of Search ..... 204/290 F, 290 R; 427/226, 229, 383.1, 383.3, 405, 419.2, 383.7, 123, 126.3, 126.5

[56] References Cited

U.S. PATENT DOCUMENTS 3,941,675 3/1976 Strasser et al. ..... 204/290 F
4,300,992 11/1981 Yoshida et al. ..... 204/290 R
4,530,742 7/1985 Carlin et al. ..... 204/290 F

FOREIGN PATENT DOCUMENTS 1373712 11/1974 United Kingdom ..... 204/290 F
2099019 12/1982 United Kingdom ..... 204/290 R

*Primary Examiner*—John F. Niebling
*Assistant Examiner*—Kathryn Gorgos
*Attorney, Agent, or Firm*—Sigalos, Levine & Montgomery

[57] ABSTRACT

A cathode especially useful in the electrolysis of aqueous solutions of alkali metal halides consisting essentially of an electrically conducting substrate and a heterogeneous coating containing a precious metal and/or a precious metal derivative; said heterogeneous coating consisting of at least two coats a and b, coat a being in contact with the substrate and containing at least one of the constituents selected from precious metals, precious metal oxides, or mixtures of precious metal oxides and at least one oxide selected from the oxides of nickel, cobalt, iron, titanium, hafnium, niobium, tantalum or zirconium, and coat b in contact with the electrolyte and with a coat a and selected from a metal of high covering power; and the process of making the cathode.

5 Claims, No Drawings

CATHODE FOR ELECTROLYSIS AND A PROCESS FOR THE MANUFACTURE OF THE SAID CATHODE

BACKGROUND OF THE INVENTION

The subject of the present invention is a novel cathode which can be used in electrolysis. It also relates to a process for the manufacture of this cathode. It relates especially to a cathode which can be used in the electrolysis of an aqueous solution of an alkali metal halide, especially remarkable for the low value of its operating potential and for the stability in time of its electrochemical performances.

This cathode belongs to the group of activated, metallic cathodes which are obtained by coating a cathodic substrate by means of various activating materials, essentially aimed at reducing the hydrogen overvoltage in an alkaline medium.

European Patent Application No. 0,129,374 describes cathodes carrying a coating consisting of a mixture of at least one metal of the platinum group and at least one oxide of a metal of the platinum group; the metal of the platinum group representing 2 to 30% of the weight of the said mixture.

Japanese patent application published under No. 57-13,189 describes a nickel or nickel alloy cathode carrying a coating which consists of a metal of the platinum group or an oxide of the said metal.

British Patent No. 1,511,719 describes a cathode consisting of a metallic substrate, a coating of cobalt and a second coating of ruthenium.

U.S. Pat. No. 4,100,049 describes a cathode which consists of a substrate and a coating consisting of a mixture of a precious metal oxide and a semiconductor metal oxide, especially zirconium oxide.

The Japanese patent application published under the number 54-090,080 describes a technique for the manufacture of a cathode which consists in treating a ferrous substrate with perchloric acid and then coating this cathode by fritting with active substances containing ruthenium, iridium, iron and nickel in the metallic form or in the form of a compound of the metal.

A technique for depositing a coating consisting of a nickel-palladium alloy on a substrate, for example, consisting of nickel, is also described in the U.S. Pat. No. 3,216,919. According to this patent, a coat of the alloy in the form of a powder is applied on the substrate and fritting of the said alloy powder is then carried out.

The coating of an electrode by electroplating with a ruthenium-nickel alloy has also been proposed (Russian Patent No. 264,096).

Japanese patent application published under the number 54-110,983 (U.S. Pat. No. 4,465,580) describes a cathode which carries a coating consisting of a dispersion of particles of nickel or a nickel alloy and an activator consisting of platinum, ruthenium, iridium, rhodium, palladium, or osmium or an oxide of these metals.

Japanese patent application published under the number 53-010,036 describes a cathode which has a semiconductor metal substrate and a coating of an alloy of at least one metal of the platinum group and a semiconductor metal and, if appropriate, a surface coating of at least one metal of the platinum group.

European Patent Application No. 0,129,734 describes a technique for cathode manufacture, by depositing on an electroconducting substrate, a coating solution containing a metallic oxide precursor and necessarily, a cleaning agent with a view to dissolving the most soluble parts of the substrate and/or a coat of the coating with is already deposited. This technique additionally consisting in an operation for the removal of the most volatile part of the coating solution, the said part containing the solubilized fractions of the substrate (op. cit. p. 14).

SUMMARY OF THE INVENTION

The invention provides a new cathode, which can be used especially in the electrolysis of aqueous solutions of alkali metal halides and which has a low operating potential and is stable over long periods of time in operation.

Briefly, the present invention comprises a cathode especially useful in the electrolysis of aqueous solutions of alkali metal halides consisting essentially of an electrically conducting substrate and a heterogeneous coating containing a precious metal and/or a precious metal derivative; said heterogeneous coating consisting of at least two coats a and b, coat a being in contact with the substrate and containing at least one of the constituents selected from: previous metals, precious metal oxides, or mixtures of precious metal oxides and at least one oxide selected from the oxides of nickel, cobalt, iron, titanium, hafnium, niobium, tantalum or zirconium, and coat b in contact with the electrolyte and with a coat a and selected from a metal of high covering power.

The invention also comprises the process of making such cathode as hereinafter set forth.

DETAILED DESCRIPTION

As used herein, the term "precious metals" denotes ruthenium, rhodium, palladium, osmium, iridium and platinum; the term "covering power" denotes the ratio (R) between the projected surface of the coat b and the projected surface of the substrate; and the term "high covering power" denotes a ratio R greater than 95%.

By way of illustration of the metals corresponding to this definition of high covering power, nickel, cobalt, iron and their alloys or the alloys of the former which contain an atomic proportion of less than 15% of phosphorus, boron or sulphur will especially be mentioned.

It must be understood that the cathodes according to the invention must contain a coat a in contact with the substrate and a coat b in contact with the electrolyte and with coat a, which means that they may only contain a single coat a and a single coat b or a succession of coats a and b, starting from the substrate, and ending with a coat b.

Among the cathodes according to the invention, those in which coat a consists of at least one compound chosen from the group consisting of platinum, ruthenium, rhodium, the oxides of ruthenium, iridium, rhodium, platinum, the mixtures of the above-mentioned oxides and oxides of titanium or nickel, and in which the coat b consists of nickel or cobalt are especially preferred.

In the cathodes according to the invention, the compound(s) which form(s) coat a in contact with the substrate is(are) advantageously deposited in a quantity representing from 0.2 to 5 mg/cm$^2$. Likewise, the compound(s) which form(s) coat b in contact with the electrolyte is(are) deposited in a quantity representing 1 to 15 mg/cm$^2$. The quantities of compounds which may form the optional intermediate a and b coats are not critical, but on such an assumption, it is recommended to observe the respective values mentioned above.

The material which forms the substrate may be chosen from any electrically conducting materials. It will advantageously be chosen from the group consisting of nickel, stainless steel and mild steel, without this listing being limiting.

The substrate may be in the form of a plate, sheet, lattice, metal sheeting or expanded metal, or grids, it being possible for the said materials to be of planar or cylindrical shape or any other shape depending on the technology employed or use intended.

The invention also relates to a process for the manufacture of these cathodes.

This process consists essentially in depositing on the substrate, optionally first subjected to a suitable preliminary treatment, coats of one or more compounds leading to the metals or compounds which form coats a and b (hereafter called precursors) and then subjecting the coated cathode to a treatment resulting in the chemical form sought (metal, oxide).

The preliminary treatment of the substrate consists advantageously of a degreasing, if necessary, followed by mechanical and/or chemical cleaning, in accordance with methods which are now well known.

One or more coats of a solution or suspension containing all of the compounds leading to the metals or their oxides may be deposited on this substrate and these precursors may also be deposited separately in the form of successive coats. It is also possible to deposit one or more coats of a part of the precursors, cause the decomposition of the precursor after each coat or only after the final coat, and then repeat the same operation with the other part of the oxide precursors. The preceding description is intentionally schematic for the purpose of simplification, but it is easily understood that all the combinations of precursors are possible and that, in particular, the same precursor may be present in several coats, either alone or in combination with the same precursor in the different coats or with different precursors from one coat to another.

In general, the above-mentioned precursors are deposited in the form of a solution or suspension. Depending on the nature of the precursor, a solvent or a diluent such as water, a mineral or organic acid, or even an organic solvent may be used. An organic solvent such as dimethylformamide, an alcohol and especially ethanol, 2-propanol or 2-ethylhexanol is preferably used. In general, the atomic concentration of the metal is between $3.10^{-2}$ and 3 moles/liter, and preferably, between 1 and 2 moles/liter.

The precursors which can be used in the invention generally consist of mineral or organic salts of metals, such as, for example, halides, nitrates, carbonates, sulphates, or even acetates, acetylacetonates.

By way of illustration of the above-mentioned precursors, hydrated ruthenium chloride, hexachloroplatinic acid, hexachloroiridic acid, palladium nitrate, rhodium chloride, nickel sulphate and nickel chloride will especially be mentioned.

The deposition of the above-mentioned precursor coats may be carried out following the conventional techniques: immersion of the substrates in the solution(s), coating with a paintbrush, brush or similar implements, and electrostatic spraying. The coats a and b may also be deposited by electroplating. On the assumption of a chemical deposition of coat b, it may be advantageous to carry out a sensitization of coat a previously deposited. This conventional treatment which consists in a succession of sensitization/rinsing phases, is described, for example, in Modern Electroplating by F. LOWENHEIM—John Wiley & Sons 1974 pp. 644 to 646.

The preparation of the solutions and the deposition of the said solutions are generally carried out at ambient temperature and in air. Naturally, should it be appropriate, the temperature may be increased, especially to make it easier for certain precursors to be dissolved, and/or the operation may be carried out in an atmosphere of nitrogen or other gas which is unreactive towards the precursors.

The conversion of the precursors of coat a is generally carried out by heat treatment. This treatment is advantageously preceded by stoving in air, intended to eliminate part or all of the solvent or diluent. This stoving may take place at a temperature which may go up to 200° C., the temperature range from 100° to 150° C. being especially recommended. The duration of this treatment is some tens of minutes. The treatment proper is generally carried out in air at a temperature which varies, depending on the precursors used, between 200° and 1,000° C. The operation is preferably carried out at a temperature of between 400° and 750° C. The duration of this heat treatment is generally between 15 min and 1 hour per coat. This heat treatment may be carried out after each stoving or after the final stoving in the case of the deposition of several coats.

The cathode of the invention is suitable for use in electrolysis cells with the production of hydrogen in a basic medium. The cathode is especially suitable for the electrolysis of aqueous solutions of alkali metal chlorides and especially of aqueous solutions of sodium chloride and for the electrolysis of water, for example in the electrolysis of aqueous solutions of potassium hydroxide. Microporous diaphragms may be used as separators in the electrolysis cells, but the cathodes according to the invention are of very special interest in membrane technology.

The invention will be further described in connection with the following examples which are set forth for purposes of illustration only.

EXAMPLE 1

The substrate consists of a nickel plate 200×10×1 mm in size. A surface treatment is carried out using corundum (equivalent mean bead diameter: 250 μm)

(a) A solution of 2 g of $RuCl_3$. x HCl y $H_2O$, containing approximately 38% by weight of ruthenium metal, in 2 $cm^3$ of ethanol, is prepared at 23° C., and the nickel plate is coated using this solution.

Stoving is carried out in air (120° C., 30 min) followed by a heat treatment in air (500° C., 30 min), and a deposit of 0.55 mg/$cm^2$ of $Ru0_2$ is obtained.

(b) Three solutions are prepared at 23° C.:

Solution A: the aqueous solution, with 4 $cm^3$/L of concentrated HCl, containing 1 g/l of $PdCl_2$;

Solution B: the aqueous solution containing 50 g/l of $NaH_2PO_2$; and

Solution C: the aqueous solution containing 20 g/l of $NiSO_4.7H_2O$; 30 g/l of $(NH_4)_2SO_4$; 30 g/l of $NaH_2PO_2.H_2O$; 10 g/l of sodium citrate, 10 $cm^3$/l of 20% (by weight) $NH_4OH$.

The nickel plate coated according to a, is successively immersed in Solution A at ambient temperature for 1 min, in Solution B at a temperature of 30° C. for 1 min, and then in 200 $cm^3$ of Solution C which is maintained at 30° C. for 60 min. A 2.29 mg/cm$^2$ deposit of Ni in the form of a nickel/phosphorus alloy containing less than 15% (in atoms) of phosphorus is thus obtained.

(c) This cathode, tested in a 450 g/l solution of sodium hydroxide, at 85° C. and using 50 A/dm$^2$ has an operating potential of −1,220 mV relative to the saturated calomel electrode (S.C.E.).

(d) A disc, 80 mm in diameter, consisting of an expanded and laminated nickel grid, coated with $RuO_2$/-chemical nickel following the process described above, is used as the cathode of a sodium chloride aqueous solution electrolysis cell—membrane technology. The operating conditions are:

intensity=30 A/dm$^2$ temperature=85° C.

sodium hydroxide, 32% by weight.

It is observed:

(i) that the voltage at the terminals of this cell shows a gain of 300 mV when compared to the voltage at the terminals of a cell in which the cathode consists only of uncoated nickel, and (ii) that this gain is constant at 300 mV after 90 days of continuous operation.

EXAMPLE 2

A substrate made of nickel which has been subjected to a surface treatment under the conditions of Example 1 is used.

(a) A solution of 2 g of $H_2IrCl_6$. $xH_2O$, containing approximately 39% by weight of iridium metal, in 2 cm$^3$ of ethanol, is prepared at 23° C. Two coats of this solution are deposited on the nickel substrate, according to the coating/stoving/heat treatment sequence of Example 1. A deposition of 1.5 mg/cm$^2$ of $IrO_2$ is obtained.

(b) The nickel plate coated according to a, is successively immersed in Solutions A, B and C according to the procedure described in Example 1. A deposition of 1.9 mg/cm$^2$ of nickel in the form of a nickel/phosphorus alloy is obtained.

(c) This cathode carrying a double coating has an operating potential of −1,310 mV relative to the S.C.E. (tested in sodium hydroxide as in Example 1).

EXAMPLE 3

A nickel substrate treated as in Example 1 is used.

(a) A nickel plate is coated using a $Pd(NO_3)_2$ solution containing approximately 16% by weight of palladium metal.

A stoving in air (120° C., 30 min) is carried out, followed by a heat treatment in air (500° C., 30 min). A deposition of 1 mg/cm$^2$ of PdO is obtained.

(b) The nickel plate coated according to a, is successively immersed in Solutions A, B and C according to the procedure described in Example 1.

A deposition of 3.4 mg/cm$^2$ of nickel in the form of a nickel/phosphorus alloy is obtained.

(c) This cathode carrying a double coating has an operating potential of −1,235 mV relative to the S.C.E. (tested in sodium hydroxide as in Example 1).

EXAMPLE 4

A nickel substrate treated as in Example 1 is used.

(a) A coat of an $RhCl_3$. $xH_2O$ solution is deposited on the nickel substrate, according to the coating/stoving-/heat treatment sequence of Example 1.

A deposition of 0.4 mg/cm$^2$ of $Rh_2O_3$ is obtained.

(b) The nickel plate coated according to a, is successively immersed in Solutions A, B and C according to the procedure described in Example 1.

A deposition of 4.85 mg/cm$^2$ of nickel in the form of a nickel/phosphorus alloy is obtained.

(c) This cathode carrying a double coating, has an operating potential of −1,290 mV relative to the S.C.E. (tested in sodium hydroxide as in Example 1).

EXAMPLE 5

A nickel substrate treated as in Example 1 is used.

(a) A solution corresponding to a weight ratio of ruthenium/titanium of 1, containing 4.37 g of $RuCl_3$. xHCl. $yH_2O$, containing approximately 38% by weight of ruthenium metal; 6.46 cm$^3$ of a 2.5 mole/L solution of $TiOCl_2$.2HCl; 4.46 cm$^3$ of 2-propanol is prepared at 23° C.

A coat of this solution is deposited on the nickel substrate, according to the coating/stoving/heat treatment sequence of Example 1. A deposition of 1.4 mg/cm$^2$ of $RuO_2$ and $TiO_2$ is obtained.

(b) The nickel plate coated according to a, is successively immersed in the Solutions A, B and C according to the procedure described in Example 1.

A deposition of 2.55 mg/cm$^2$ of nickel in the form of a nickel/phosphorus alloy is obtained.

(c) This cathode, carrying a double coating, has an operating potential of −1,230 mV relative to the S.C.E. (tested in sodium hydroxide as in Example 1).

EXAMPLE 6

A nickel substrate which has been subjected to a surface treatment under the conditions of Example 1 is used.

(a) Two solutions are prepared at 23° C.:

Solution D: the solution of 1 g of $RuCl_3$. xHCl. $yH_2O$ in 1 cm$^3$ of ethanol of Example 1, and Solution E: a solution of 1 g of $Ni(NO_3)_2.6H_2O$ in 1 cm$^3$ of ethanol.

One coat of Solution D is first deposited on the nickel substrate (coating/stoving/heat treatment sequence of Example 1), and then, after cooling, 2 coats of Solution E (also following the coating, stoving, heat treatment sequence of Example 1) are deposited.

A deposition of 1.94 mg/cm$^2$ of $RuO_2$ and NiO (1/1 weight ratio of oxide) is obtained.

(b) The nickel plate coated according to a, is successively immersed in Solutions A, B and C according to the procedure described in Example 1.

A deposition of 2.4 mg/cm$^2$ of nickel in the form of a nickel/phosphorus alloy is obtained.

(c) This cathode, carrying a triple coating, has an operating potential of −1,225 mV relative to the S.C.E. (tested in sodium hydroxide as in Example 1).

EXAMPLE 7

A nickel substrate treated as in Example 1 is used.

(a) A solution of 2 g of $H_2PtCl_6.6H_2O$, containing approximately 38% by weight of platinum metal in 2 cm$^3$ of ethanol is prepared at 23° C. Two coats of this solution are deposited on the nickel substrate, according to the coating/stoving/heat treatment sequence of Example 1.

A deposition of 0.95 mg/cm$^2$ of platinum metal is obtained.

(b) The nickel plate coated according to a, is successively immersed in Solutions A, B and C according to the procedure described in Example 1.

A deposition of 2.9 mg/cm$^2$ of nickel in the form of a nickel/phosphorus alloy is obtained.

(c) This cathode, carry a double coating, has an operating potential of −1,300 mV relative to the S.C.E. (tested in sodium hydroxide as in Example 1).

EXAMPLE 8

A nickel substrate treated as in Example 1 is used.

(a) A Solution F containing 15 g/l of $RuCl_3$. x HCl. y $H_2O$ which contains approximately 38% by weight of ruthenium metal, and 12.5 g/l of $NH_2OH.HCl$ is prepared at 23° C.

A deposition of the ruthenium metal on the nickel substrate is carried out by the electrolysis of the solution F at a temperature of 30° C. using a current density of 15 A/dm$^2$for 60 min.

A deposition of 1.36 mg/cm$^2$ of ruthenium metal is obtained.

(b) The nickel plate coated according to a, is successively immersed in Solutions A, B and C according to the procedure described in Example 1. A deposition of 2 mg/cm$^2$ of nickel in the form of nickel/phosphorus is obtained.

(c) This cathode, carrying a double coating, has an operating potential of -1,200 mV relative to the S.C.E. (tested in sodium hydroxide as in Example 1).

EXAMPLE 9

A nickel substrate treated as in Example 1 is used.

(a) The solution of 1 g of $RuCl_3$.x HCl. y$H_2O$ of Example 1 in 1 cm$^3$ of ethanol is prepared at 23° C.

A coat of this solution is deposited on the nickel substrate according to the coating/ stoving/heat treatment sequence of Example 1.

A deposition of 0.79 mg/cm$^2$ of $RuO_2$ is obtained.

(b) A Solution G containing 30 g/l of $CoCl_2.6H_2O$; 20 g/l of $NaH_2PO_2.H_2O$; 29.6 g/l of sodium citrate; 50.0 g/l of $NH_4Cl$; 30 cm$^3$/l of 20% $NH_4OH$ (by weight) is prepared at 23° C.

The nickel plate coated according to a, is successively immersed in Solution A (of Example 1) at ambient temperature for 1 min, in Solution B (of Example 1) at a temperature of 30° C. for 1 min, then in 200 cm$^3$ of Solution G maintained at 80° C. for 20 min.

A deposition of 2 mg/cm$^2$ of cobalt in the form of a cobalt/phosphorus alloy containing less than 15% (in atoms) of phosphorus is contained.

(c) This cathode, carrying a double coating, tested in sodium hydroxide at a concentration of 450 g/l, at 85° C. and using 50 A/dm$^2$ has an operating potential of −1,180 mV relative to the S.C.E.

EXAMPLE 10

A nickel substrate which has been subjected to a surface treatment under the conditions of Example 1 is used.

(a) The solution of 1 g of $RuCl_3$. xHCl. y$H_2O$ of Example 1 in 1 cm$^3$ of ethanol is prepared at 23° C.

Two coats of this solution are deposited on the nickel substrate according to the coating/ stoving/heat treatment sequence of Example 1. A deposition of 1.6 mg/cm$^2$ of $RuO_2$ is obtained.

(b) A deposition of electroplating Ni on the substrate coated according to a is carried out by electrolysis of an aqueous solution containing 300 g/l of nickel chloride and 38 g/l of $H_3BO_3$ at a temperature of 60° C. using a current density of 5 A/dm$^2$ for 30 min (volume of solution: 400 cm$^3$).

A deposition of 4.3 mg/cm$^2$ of nickel metal is obtained.

(c) This cathode, carrying a double coating, has an operating potential of −1,200 mV relative to the S.C.E. (tested in sodium hydroxide of Example 1).

EXAMPLE 11

The test of Example 1 is repeated using 30 cm$^3$/l of 20% $NH_4OH$ (by weight) in Solution C.

10.0 mg/cm$^2$ of nickel in the form of a nickel/phosphorus alloy is thus deposited, after 2 hours in the said Solution C maintained at 30° C.

The operating potential measured under the conditions of Example 1 c is −1,240 mV relative to the S.C.E.

EXAMPLE 12

The test of Example 1 is repeated, replacing the nickel substrate with a mild steel substrate, treated as in this Example 1.

(a) The solution of 1 g of $RuCl_3$. x HCl. y $H_2O$ of Example 1 in 1 cm$^3$ of ethanol is prepared at 23° C.

A coat of this solution is deposited on the mild steel substrate according to the coating/stoving/heat treatment sequence of Example 1.

A deposition of 0.6 mg/cm$^2$ of $RuO_2$ is obtained.

(b) The mild steel plate coated according to a, is successively immersed in Solutions A, B and C according to the procedure described in Example 1.

A deposition of 3.2 mg/cm$^2$ of nickel in the form of a Ni-P alloy containing less than 15% (in atoms) of phosphorus is obtained.

(c) This cathode containing a double coating has an operating potential of −1,240 mV relative to the S.C.E. (tested in sodium hydroxide as in Example 1).

EXAMPLE 13

A nickel substrate which has been subjected to a surface treatment under the conditions of Example 1 is used.

(a) The solution of 1 g of $RuCl_3$.x HCl. y $H_2O$ of Example 1 in 1 cm$^3$ of ethanol is prepared at 23° C.

A coat of this solution if deposited on the nickel substrate according to the coating/stoving/heat treatment sequence of Example 1.

A deposition of 0.6 mg/cm$^2$ of $RuO_2$ is obtained.

(b) The nickel plate coated according to a, is immersed in Solution C of Example 1 at a temperature of 40° C. for 100 min.

A deposition of 5.25 mg/cm$^2$ of nickel in the form of a Ni-P alloy containing less than 15% of phosphorus is thus obtained.

(c) This cathode carrying a double coating has an operating potential of −1,200 mV relative to the S.C.E. (tested in sodium hydroxide as in Example 1).

COMPARATIVE EXAMPLE 1A

A deposition of 2.2 mg/cm$^2$ of nickel on the nickel substrate which has been subjected to the surface treatment according to Example 1 is carried out according to the procedure described in Example 1, paragraph b.

This cathode, tested in sodium hydroxide as in Example 1, has an operating potential of −1,490 mV relative to the S.C.E.

COMPARATIVE EXAMPLE 9A

A deposition of 1.7 mg/cm$^2$ of cobalt on the nickel substrate which has been subjected to the surface treatment according to Example 1 is carried out according to the procedure described in Example 9, paragraph b.

This cathode, tested in sodium hydroxide as in Example 1, has an operating potential of −1,480 mV relative to the S.C.E.

COMPARATIVE EXAMPLE 10A

A deposition of 5 mg/cm$^2$ of nickel on the nickel substrate which has been subjected to the surface treatment according to Example 1 is carried out according to the procedure described in Example 10, paragraph b.

This cathode, tested in sodium hydroxide as in Example 1, has an operating potential of -1,640 mV relative to the S.C.E.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A cathode especially useful in the electrolysis of aqueous solutions of alkali metal halides consisting essentially of an electrically conducting substrate and a heterogeneous coating; said heterogeneous coating consisting of at least two coats a and b, coat a being in contact with the substrate and containing at least one of the constituents selected from precious metals, precious metal oxides, or mixtures of precious metal oxides and at least one oxide selected from the oxides of nickel, cobalt, iron, titanium, hafnium, niobium, tantalum or zirconium, and coat b in contact with the electrolyte and with a coat a and is a metal selected from nickel, cobalt, iron, their alloys, or the alloys of the former containing an atomic proportion of less than 15% phosphorous, boron, or sulfur, such that the ratio between the projected surface of the coat b and the projected surface of the substrate is greater than 95%.

2. The cathode of claim 1 wherein coat a consists of at least one compound from platinum, ruthenium, rhodium; oxides of ruthenium, iridium, rhodium, platinum; or mixtures of such oxides and the oxides of titanium or nickel, and in which the coat b consists of nickel or cobalt.

3. The cathode of claim 1 characterized in that the compound which forms the coat a is deposited in a quantity representing from 0.2 to 5 mg/cm$^2$.

4. The cathode of any one of claims 1, 4, and 5 wherein the compound which forms the coat b in contact with the electrolyte is deposited in a quantity representing 1 to 15 mg/cm$^2$.

5. A process for the manufacture of a cathode comprising depositing on an electrically conducting substrate coats of one or more compounds leading to the metals or compounds which form at least two coats, a, and b, coat a being in contact with the substrate and containing at least one of the constituents selected from precious metals, precious metal oxides, or mixtures of precious metal oxides and at least one oxide selected from the oxides of nickel, cobalt, iron, titanium, hafnium, niobium, tantalum or zirconium, and coat b in contact with the electrolyte and with a coat a and is a metal solution from nickel, cobalt iron, their alloys or the alloys of the former contouring an atomic proportion of lens view 15% phosphorous, boron or sulfur such that the ratio between the projected surface of the coat b and the projected surface of the substrate is greater than 95%, and then subjecting the coated cathode after each deposition or after all coatings have been deposited to a treatment until the requisite metal or oxide form is obtained for each coating.

* * * * *